US011998117B2

(12) United States Patent
Lu et al.

(10) Patent No.: US 11,998,117 B2
(45) Date of Patent: Jun. 4, 2024

(54) SILENT AIR PUMP BOX AND INTELLIGENT ADJUSTMENT MATTRESS

(71) Applicant: SHENZHEN GLAMOUR TECHNOLOGY CO., LTD, Shenzhen (CN)

(72) Inventors: Kuntao Lu, Shenzhen (CN); Zhong Liu, Shenzhen (CN); Yong Le, Shenzhen (CN)

(73) Assignee: SHENZHEN GLAMOUR TECHNOLOGY CO., LTD

( * ) Notice: Subject to any disclaimer, the term of this patent is extended or adjusted under 35 U.S.C. 154(b) by 272 days.

(21) Appl. No.: 17/636,385

(22) PCT Filed: Oct. 22, 2019

(86) PCT No.: PCT/CN2019/112604
§ 371 (c)(1),
(2) Date: Feb. 18, 2022

(87) PCT Pub. No.: WO2021/077304
PCT Pub. Date: Apr. 29, 2021

(65) Prior Publication Data

US 2022/0265057 A1 Aug. 25, 2022

(51) Int. Cl.
*A47C 27/08* (2006.01)
*F04B 39/00* (2006.01)

(52) U.S. Cl.
CPC ..... *A47C 27/082* (2013.01); *A47C 27/083* (2013.01); *F04B 39/0033* (2013.01)

(58) Field of Classification Search
CPC ..... F04B 39/0033; F04B 39/121; F04B 39/0044; A47C 27/082; A47C 27/083
See application file for complete search history.

(56) References Cited

U.S. PATENT DOCUMENTS

| | | | | |
|---|---|---|---|---|
| 2004/0191084 | A1* | 9/2004 | Wang | F04B 39/0033 417/312 |
| 2004/0219033 | A1* | 11/2004 | Narney, II | F04B 39/0027 417/313 |
| 2017/0191390 | A1* | 7/2017 | Kikuchi | F01N 1/163 |
| 2021/0244195 | A1* | 8/2021 | Elengical | A47C 27/083 |

FOREIGN PATENT DOCUMENTS

| | | | |
|---|---|---|---|
| CN | 2127244 | Y * | 2/1993 |
| CN | 201218181 | Y * | 4/2009 |
| CN | 204126852 | U * | 1/2015 |
| CN | 204131295 | U * | 1/2015 |
| CN | 205388000 | U * | 7/2016 |
| CN | 105909499 | A * | 8/2016 |
| CN | 205503419 | U * | 8/2016 |
| CN | 205677805 | U * | 11/2016 |
| CN | 206770175 | U * | 12/2017 |

(Continued)

*Primary Examiner* — Eric J Kurilla
(74) *Attorney, Agent, or Firm* — Jose Cherson Weissbrot

(57) ABSTRACT

The present disclosure discloses a silent air pump box comprising a box body, an upper cover, a supporting platform, an air pump, an air valve, an air pipe and a silencing pipe. The present disclosure further provides an intelligent adjustment mattress, which comprises the silent air pump box and an airbag layer, wherein the silent air pump box is provided at the tail of the mattress.

10 Claims, 8 Drawing Sheets

(56) References Cited

FOREIGN PATENT DOCUMENTS

| | | | | | |
|---|---|---|---|---|---|
| CN | 108506198 | A | * | 9/2018 | ..... A47C 27/082 |
| CN | 108778356 | A | | 11/2018 | |
| CN | 108778356 | A | * | 11/2018 | ..... A61M 1/0066 |
| CN | 208089516 | U | * | 11/2018 | ..... A47C 27/082 |
| CN | 109171315 | A | | 1/2019 | |
| CN | 209469550 | U | | 10/2019 | |
| CN | 209469550 | U | * | 10/2019 | |
| CN | 210799295 | U | * | 6/2020 | ..... A47C 27/082 |

* cited by examiner

SILENT AIR PUMP BOX AND INTELLIGENT ADJUSTMENT MATTRESS

CROSS REFERENCE

The instant application is a continuation of PCT/CN2019/112604, filed on Oct. 22, 2019, which is incorporated by reference.

TECHNICAL FIELD

The present disclosure relates to the technical field of intelligent mattresses, in particular to a silent air pump box and an intelligent adjustment mattress comprising the silent air pump box.

BACKGROUND

People spend one third of time on sleep, which shows that sleep is the most basic physiological need of people. However, according to the survey of the World Health Organization, nearly 27% people in the world have sleep problems. Therefore, how to ensure healthy sleep is a topic of great concern.

The mattress, as an important carrier of sleep, will directly affect the sleep quality of the user. The mattress is very important for the improvement of sleep quality. Traditional mattresses are mainly divided into spring mattresses, sponge mattresses, palm mattresses, latex mattresses, water mattresses and airbag mattresses. A good mattress should be structurally designed according to the weight distribution of various parts of the human body and the normal curve of the spine, in which the hardness and softness is an important parameter of the mattress. A mattress that is too soft makes the trunk of the human body droop, which is not good for keeping the spine bent. However, a mattress that is too hard is easy to cause muscle compression and poor blood flow, which leads to an increase in the number of turns during sleep, so that the user cannot get enough rest. In addition, the mattress that is too hard lacks proper elasticity and cannot fit the normal curve of the spine. Long-term use will affect the posture of the human body and hinder the health of the spine. Especially, the bone development of teenager is closely related to the mattress. A mattress that is too hard or too soft will cause spinal dysplasia. However, the softness and hardness of most existing mattresses on the market are fixed. For a double-mattress, for example, a couple may not necessarily be suitable for the same softness and hardness.

At present, sonic mattresses can be customized with different softness and hardness on both sides (left and right), so as to meet different requirements of a couple for the softness and hardness. For example, for some airbag mattresses, the airbags on both sides can be inflated and deflated independently to achieve inconsistent softness and hardness on both sides. However, in fact, different trunk parts and different sleeping postures of the same person have different support requirements for the mattress. For example, when lying flat, due to the curvature of human spine, it is often impossible to get enough support at the waist, while the hip is often the place where the pressure is too heavy. When lying on the side, the shoulder is often the place where the pressure is the most severe. Therefore, we need a mattress that can adjust the softness and hardness of all parts of the mattress in real time according to the sleeping posture of the human body, protect the human spine, relax the muscles and circulate the blood, so as to achieve the healthiest sleep.

Further, the air pump in the intelligent adjustment mattress is often too noisy so the sleep of the user is affected.

SUMMARY

In order to solve the above problems, the embodiments of the present disclosure provide a silent air pump box for a mattress and a partitioned airbag mattress, wherein the mattress can acquire the pressure values of each airbag through air pressure sensing according to different sleeping postures of the human body. The air pump and air valve in the mattress of the present disclosure can independently inflate and deflate each airbag, so as to achieve the purpose of adjusting the pressure of various parts of the human body.

The first aspect of the present disclosure provides a silent air pump box, comprising a box body, an upper cover, a supporting platform, an air pump, an air valve, an air pipe, a silencer cotton, a sound insulation cotton and a silencing pipe, wherein the box body is buckled with the upper cover to form a closed space, the supporting platform, the air pump, the air valve, the air pipe, the silencer cotton and the silencing pipe are all provided in the box body, and the air pump, the air valve, the air pipe and the silencing pipe are all suspended and fixed below the supporting platform.

Further, an air valve flexible cushion is provided between the air valve and the supporting platform.

Further, the silencing cotton and the sound insulation cotton are provided inside the box body and the upper cover from outside to inside.

Further, the air pump is suspended on the supporting platform by a suspension belt, wherein the suspension belt is a silicone belt or a rubber belt, and the upper cover and the supporting platform are detachably connected or integrated.

Further, the supporting platform is provided in the box body through a plurality of supporting columns, and the bottom of the supporting columns is bonded with a silica gel or rubber structure.

The second aspect of the embodiment of the present disclosure provides an intelligent adjustment mattress, comprising the silent air pump box and an airbag layer, wherein the silent air pump box is provided at the tail of the intelligent adjustment mattress.

Further, the airbag layer comprises multi-area independently adjustable airbags and sponges, wherein the airbags are surrounded by sponges, and the sponges surrounding the airbags are divided into airbag peripheral sponges, airbag gap sponges and airbag middle sponges.

Further, in the airbag layer, the width of the airbag in the trunk area is smaller than that in the leg and head areas.

Further, air is injected or a spring or sponge is implanted into the airbag, and the height of the spring or sponge is not less than half of the inner height of the airbag.

Further, the intelligent adjustment mattress further comprises an air pressure sensor, a data unit and a control unit, and the intelligent adjustment mattress acquires the personal sleep information and algorithm parameters of a user in a pre-entry manner, so as to realize the personalized parameter customization of the mattress.

The silent air pump box of the present disclosure realizes the silent design by combining a silica gel suspension air pump with a multi-sound insulation and silencing device. Meanwhile, the intelligent adjustment mattress provided by the present disclosure comprises split independent adjustable airbags, which realizes the intelligent independent adjustment; and meanwhile, the personal sleep information and algorithm parameters of a user are acquired in a pre-entry manner, and the personalized parameter customization of the mattress is completed.

BRIEF DESCRIPTION OF THE DRAWINGS

In order to explain the technical scheme of the embodiments of the present disclosure more clearly, the drawings used in the description of the embodiments of the present disclosure will be briefly introduced hereinafter. Obviously, the drawings in the following description are only some embodiments of the present disclosure. For those skilled in the art, other drawings can be obtained according to these drawings without paying creative labor.

DETAILED DESCRIPTION OF TILE EMBODIMENTS

The technical scheme of the present disclosure will be clearly and completely described with reference to the drawings in the embodiments of the present disclosure hereinafter. Obviously, the described embodiments are only some embodiments of the present disclosure, rather than all of the embodiments. Based on the embodiments in the present disclosure, all other embodiments obtained by those skilled in the art without paying creative labor fall within the scope of protection of the present disclosure.

Figure 1:
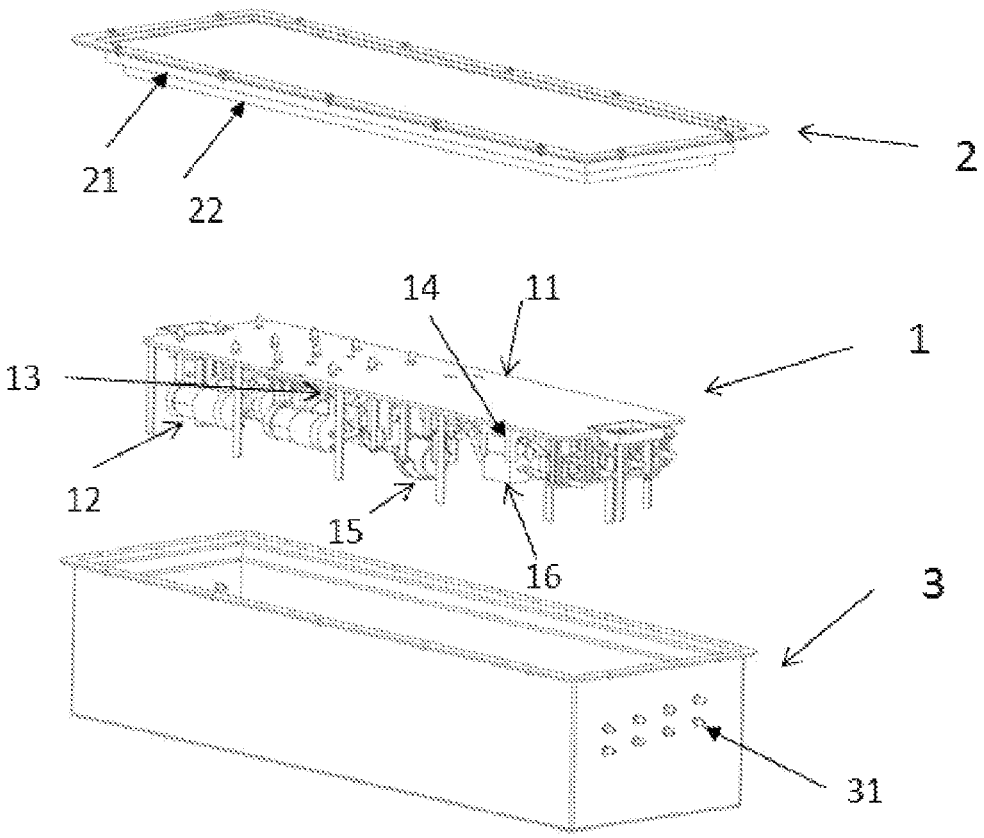
FIG. 1 is a structural schematic diagram of a silent air pump box according to an embodiment of the present disclosure.

The first embodiment of the present disclosure provides a silent air pump box 1, as shown in FIG. 1, wherein the silent air pump box 1 comprises a silent box body 3, which is mainly used to accommodate some noise source devices therein for sound insulation treatment. The side of the box body 3 is provided with an air pipe interface 31, and an air pump 12, an air valve 16, an air pipe 13 and a silencing pipe 15 are provided inside the box body. The upper cover 2 is provided on the silent box body 3, and the upper cover 2 and the box body 3 can be sealed and buckled. The box body 3 can be a metal box body, a rigid box body made of other materials, or liquid. The upper cover 2 can be made of metal or other rigid materials. The upper cover 2 and the box body 3 are fixed by screws to form a closed space to prevent noise from spreading to the outside through the air. The upper cover 2 and the box body 3 are respectively provided with a sound insulation cotton 21 and a silencer cotton (also referred to as a sound absorption cotton) 22 from outside to inside, that is, the silencer cotton 22 is in the innermost layer, the sound insulation cotton 21 is closely attached to the upper cover 2 and the box body 3, and the sound insulation cotton, the upper cover and the box body can be bonded together. The sound insulation air pump box 2 further comprises a supporting platform 11 for suspending and fixing the air pump. The air pump 13 is the power source of inflating an airbag, which can be a diaphragm pump, an electromagnetic pump, an impeller pump, a piston pump, etc. In one embodiment of the present disclosure, one air pump 13 can be used, or a plurality of air pumps 13 can be connected in parallel to achieve a larger amount of air flow. One embodiment of the present disclosure may comprise a plurality of air pumps 13, as shown in FIG. 1. The air valve 16 is used to control the inflation and deflation of the designated airbag by controlling the air pump. The intelligent mattress of the present application controls the on/off of the air valve by electrical signals to select the flow path of the air path. The air valve 16 may be a solenoid valve. In the practical application, an air pump and an air valve are the main noise sources. The air pump 13, the air valve 16, the air pipe 13 and the silencing pipe 15 are all fixed on the supporting platform 11 through the suspension structure, and an air valve flexible cushion 14 is sandwiched between the air valve 16 and the supporting platform 11, wherein the function of the air valve flexible cushion 14 is mainly to weaken the vibration of the air valve 16, so as to avoid transmitting the vibration and sound to the supporting platform 11, therefore, no sound or vibration can be felt above the supporting platform. The flexible cushion layer 14 can be made of silica gel or other materials with sound insulation properties. In one embodiment of the present disclosure, silencing pipes 15 are inserted into the paths of inflation and deflation, respectively, in order to reduce the airflow sound of the air pump 12 during inflation and deflation. In the inflation path, one end of the silencing pipe is connected with the air pump, and the other end thereof is connected with the air valve. In the deflation path, one end of the silencing pipe is connected with the deflation air valve, and the other end thereof is connected with the atmosphere.

The improvement of the silent air pump box of the present disclosure mainly lies in the structural design of the silent box, the silent design of the air pump and the silent design of the air valve. The structural design of the silent box refers to the centralized placement of noise source components, such as the air pump and the air valve, in the silent box, further, the outer box of the silent box is made of materials with high sound resistance, the inner part is made of sound insulation and sound absorption materials, and the sealed isolation design is used, which greatly attenuates the sound intensity. The material with high sound resistance can be solid or liquid. The solid can be metal, metal alloy, metal compounds, such as iron, aluminum, silver, copper, aluminum alloy, aluminum oxide, silicon dioxide, etc. The liquid can be a compound such as water.

The improvement of the silent design of an air pump lies in minimizing the noise transmitted by the vibration of the silent box itself. The air pump can reduce the transmission of vibration by using relatively soft materials, suspending design or supporting design. In the preferred embodiment, a suspending design is used.

The improvement of the silent design of the air valve in this embodiment of the present disclosure is mainly as follows: first, soft materials are added at the bottom of the air valve to reduce the transmission of vibration; second, a soft start process is introduced through the design of hardware circuits and programs, that is, the voltage is controlled to change slowly during the on/off, so as to achieve the slow switching of the on/off; thereby reducing the noise. There are two methods to control the slow rise of voltage: one is achieved through the circuit, for example, a low-pass filter of a resistor and a capacitor is connected to the output terminal that forms the control voltage, so that the voltage signal rising by steps is converted into a slowly rising voltage; the other is to control the output waveform by programs through the digital-to-analog conversion module (DAC).

Further, two layers of materials (namely a silencer cotton and a sound absorption cotton) are adhered to the inner wall of the box body 3 from inside to outside, further reducing the energy transmitted by noise. The main purpose of the sound absorption cotton is to absorb part of sound wave energy, while the sound insulation cotton is to increase the reflection of sound waves and reduce the penetrating energy. The sound insulation cotton and the sound absorption cotton are commonly used materials. The sound insulation cotton and the sound absorption cotton of the box body 3 enclose a closed space with the sound insulation cotton and the sound absorption cotton of the upper cover 2, respectively, and the sound absorption cotton layer is inside the space.

Figure 2:
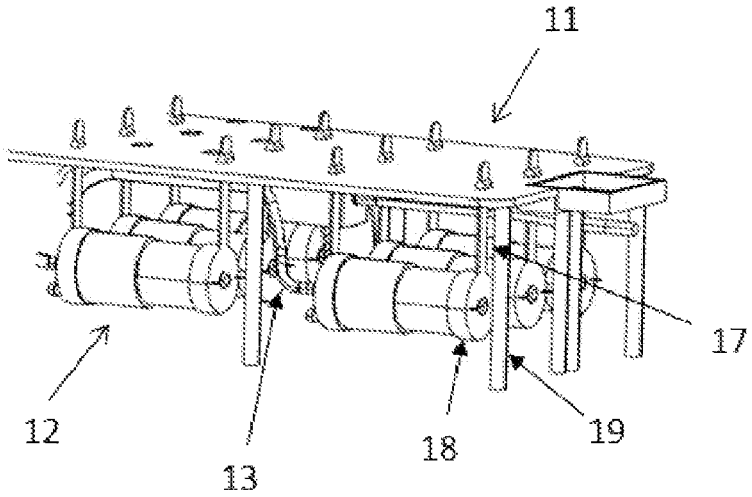
FIG. 2 is a schematic diagram of the installation of an air pump suspended from the supporting platform.

FIG. 2 further shows the suspension arrangement of the air pump. During the working process, the air pump itself will produce micro-vibration, and if the vibration is transmitted to the whole mattress through the solid medium, and then to the ears of the user, it will cause loud noise, which will seriously affect sleep and rest. In the embodiment shown in FIG. 2, a plurality of air pumps 12 are connected in parallel to increase the amount of air flow, and are suspended by a suspension belt 17. The suspension structure reduces the transmission of vibration of the air pump 12. The suspension belt 17 is preferably made of an elastic material such as silica gel or rubber. The supporting column 19 and the supporting platform 11 together build a platform, so that the air pump 12 is fixed. The peripheral supporting column 19 defines the range set by the air pump 12, while the supporting column 19 isolates the adjacent air pumps 12. The air pump 12 is wrapped with a silicone sleeve 18. Preferably, the air pump 12 is completely wrapped in the silicone sleeve 18. The air pump is suspended on the supporting platform 11 by providing the silicone sleeve and the silicone suspension belt. Moreover, the end of the supporting column 19 is fixed to the bottom of the metal box body. In order to further reduce the transmission of vibration of the supporting column 19 to the box body 3, the bottom of the supporting column 19 can also be connected with a soft material, for example, it can be bonded to the bottom of the supporting column 19 with silica gel or rubber.

Figure 3:
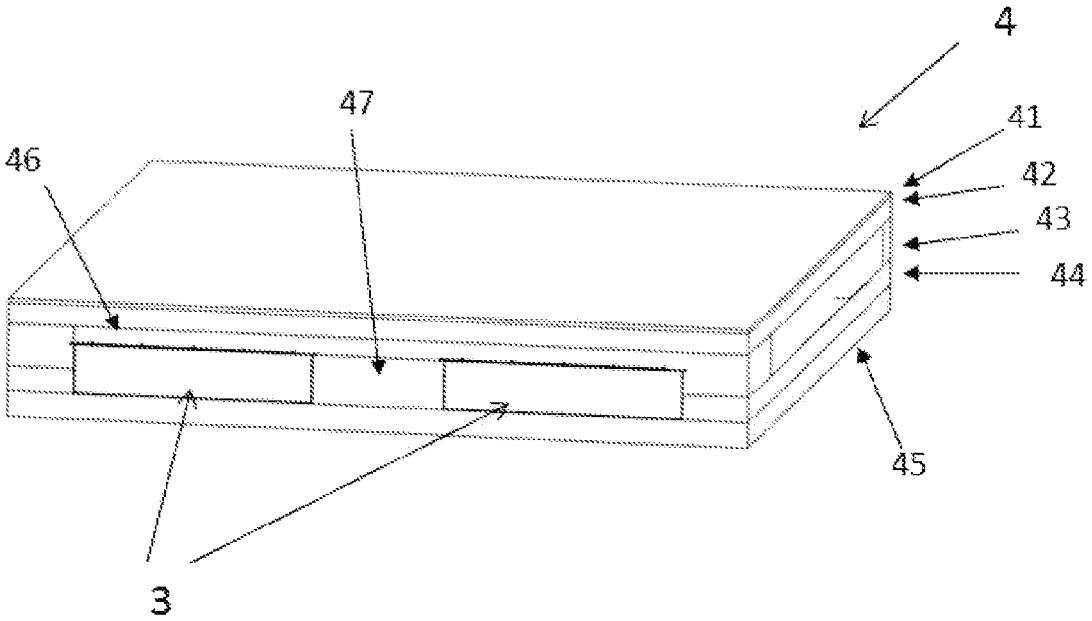
FIG. 3 is an overall structural diagram of an intelligent adjustment mattress according to an embodiment of the present disclosure.

The embodiment of the present disclosure further provides an intelligent adjustment mattress, which comprises an airbag and the above-said silent air pump box 1. FIG. 3 shows the overall structure of the intelligent adjustment mattress according to the embodiment of the present disclosure. The intelligent adjustment mattress 4 comprises a fabric layer 41, a comfort layer 42, an airbag layer 43, a first spring layer 44, a second spring layer 45, an air pump box body 3, a control box 47 and a silent protection layer 46. The fabric layer 41, the comfort layer 42, the airbag layer 43, the first spring layer 44 and the second spring layer 45 are provided in sequence from top to bottom, and the air pump box body 3, the control box 47 and the silent protection layer 46 are all provided at the tail of the mattress, that is, the feet area of a user. The fabric layer 41 and the comfort layer 42 provide the comfort and skin-friendliness of the mattress 4. According to the needs of a user, the common materials of ordinary mattresses can be used. The airbag layer 43 mainly consists of the central airbag, airbag peripheral sponges, and airbag gap sponges. The first spring layer 44 and the second spring layer 45 are mainly used as the supporting layers of the mattress to provide resilience. These two spring layers are optional structures, that is, they can be removed in some embodiments.

In particular, the first spring layer 44 is provided with a groove structure at the tail for placing the box body 3 and the control box 47 of the silent air pump box. The main purpose is to reduce the height of the silent air pump box and the control box, so that there is a thicker area thereon to ensure the comfort of a user in this area, and there will be no strong fault of softness and hardness. The upper silent protection layer 46 of the silent air pump box is designed to further optimize the comfort of a user in this area and protect the area when it is impacted. The silent protection layer 46 can use a relatively hard sponge or spring.

Figure 4:
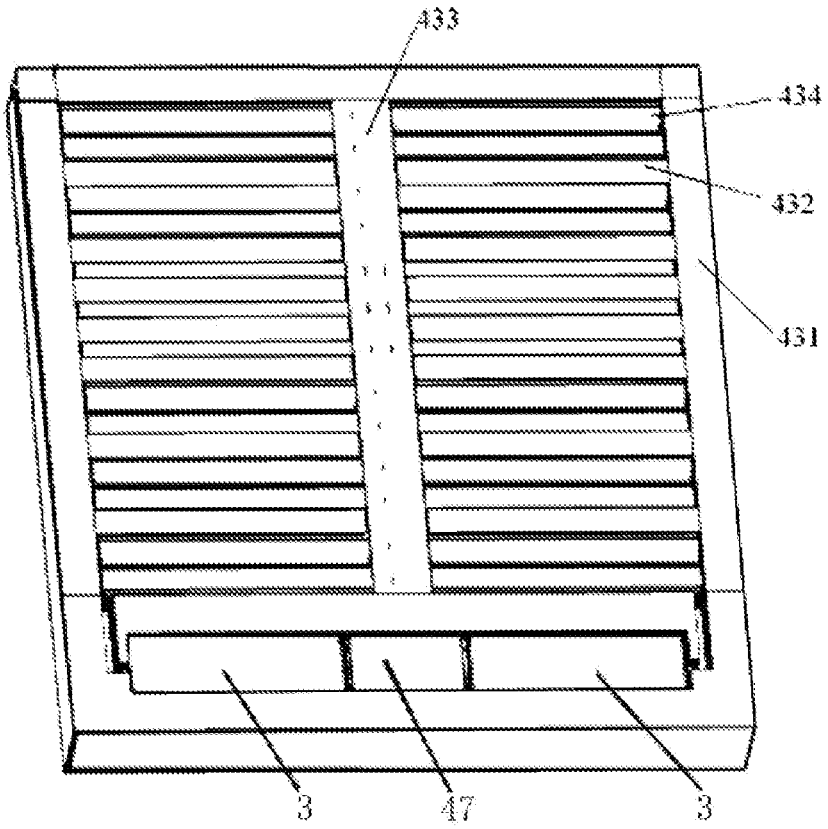
FIG. 4 is a structural diagram of an airbag layer in an intelligent adjustment mattress according to an embodiment of the present disclosure.

In particular, as shown in FIG. 4, the airbag layer 43 in the intelligent adjustment mattress provided by the present disclosure comprises an airbag peripheral sponge 431, an airbag gap sponge 432, an airbag middle sponge 433 and an airbag 434, a left silent air pump box and a right silent air pump box, and a control box 47. The airbag 434 uses the design of multi-area independent adjustment, and the airbag with smaller width is used in the trunk area to increase the accuracy of the adjustment position. However, in the leg area and the head area, airbags with wider width are used to save the cost. The airbag according to the embodiment of the present disclosure can only be filled with air, or a spring or a sponge can be implanted in the airbag to ensure that the airbag still has enough elasticity under the condition of insufficient air flow, and at the same time, ensure that the air flow of inflation and deflation is smooth. When the spring or sponge is implanted, the height of the spring or sponge is preferably not less than half of the inner height of the airbag.

The airbag in the embodiment of the present disclosure can use three design schemes: wave airbags, square airbags and stacked airbags.

Figure 5:
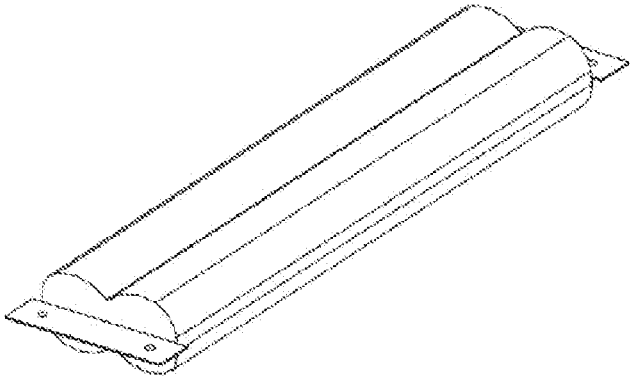
FIG. 5 and FIG. 6 are structural schematic diagrams of a large-wave airbag and a small-wave airbag, respectively.
Figure 6:
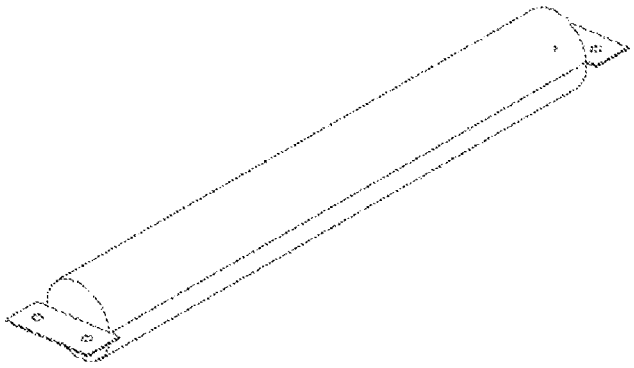
Figure 7:
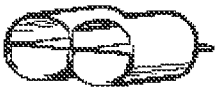
FIG. 7 is a sectional view of a large-wave airbag shown in FIG. 5.

In particular, the wave airbag can be a large-wave airbag (FIG. 5) and a small-wave airbag (FIG. 6). The size of the large-wave airbag shown in FIG. 5 after inflation is 70*20*10 cm, and the size of the small-wave airbag shown in FIG. 6 after inflation is 70*10*10 cm. The large-wave airbag has a 6.5 cm brace in the middle. In one embodiment of the present disclosure, a sponge is placed in the lower half of the airbag, and the sponge accounts for about half of the internal volume of the airbag. FIG. 7 is a sectional view of a large-wave airbag of FIG. 5, in which the lower half is filled with a sponge.

Figure 8:
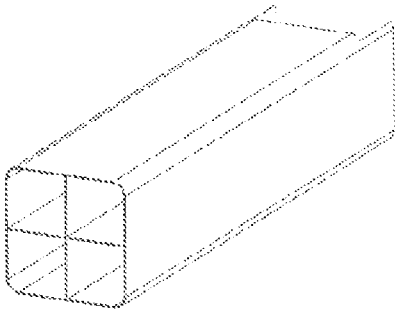
FIG. 8 and FIGS. 9A-9B are structural schematic diagrams of a large-square airbag and a small-square airbag.
Figure 9A:
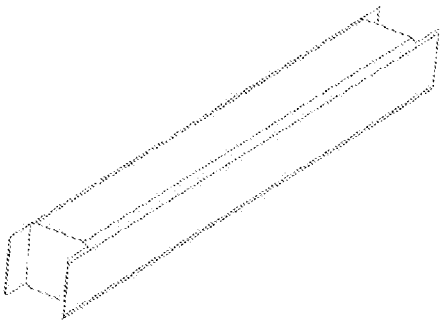
Figure 9B:
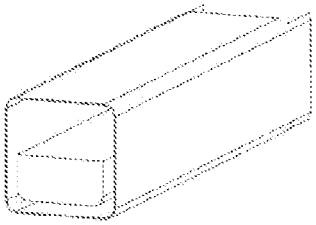

In particular, the square airbag comprises a large-square airbag (FIG. 8) and a small-square airbag (FIG. 9A). The size of the large-square airbag after inflation is 70*20*10 cm, the size of the small-square airbag after inflation is 70*10*10 cm, the large-square airbag has a cross brace in the middle, and the size of the brace is 20*10*70 cm. Preferably, the interior (lower half) of the square airbag is filled with a sponge, as shown in FIG. 9B.

Figure 10:
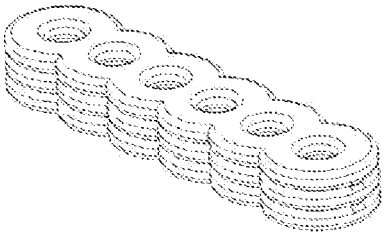
FIG. 10 and FIG. 11 are schematic diagrams of two different structures of a three-layer airbag according to an embodiment of the present disclosure.
Figure 11:
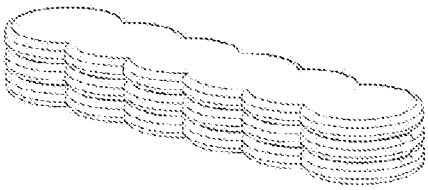

In particular, there are two types of stacked airbags, one type is that a single airbag uses a three-layer structure, as shown in FIG. 10, and the middle of the airbag is provided with a through hole running up and down; and the other type is a three-layer airbag structure, as shown in FIG. 11, and the middle of the airbag is not provided with a through hole, which is also referred to as a solid airbag.

Figure 12:
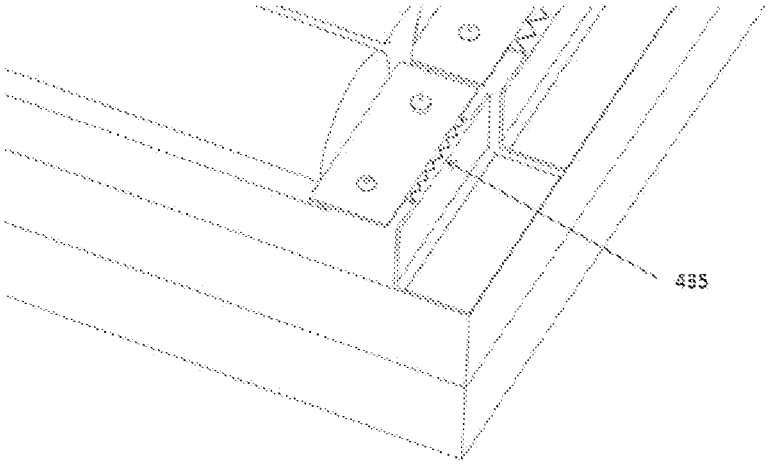
FIGS. 12-14 are the schematic diagrams of zipper connection and buckle connection of an airbag, respectively.
Figure 13:
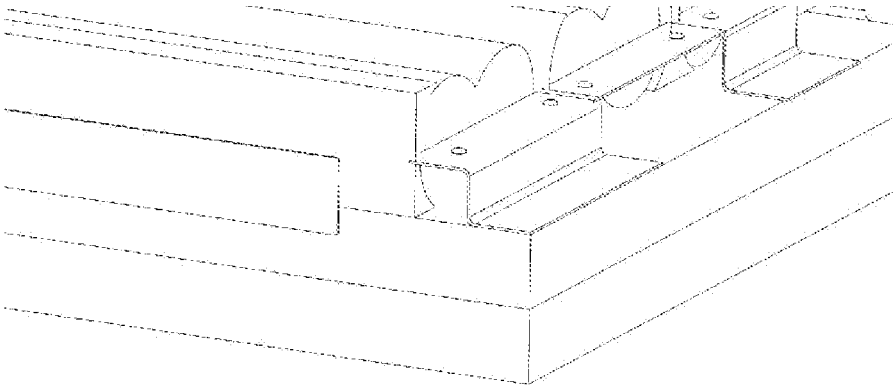
Figure 14:
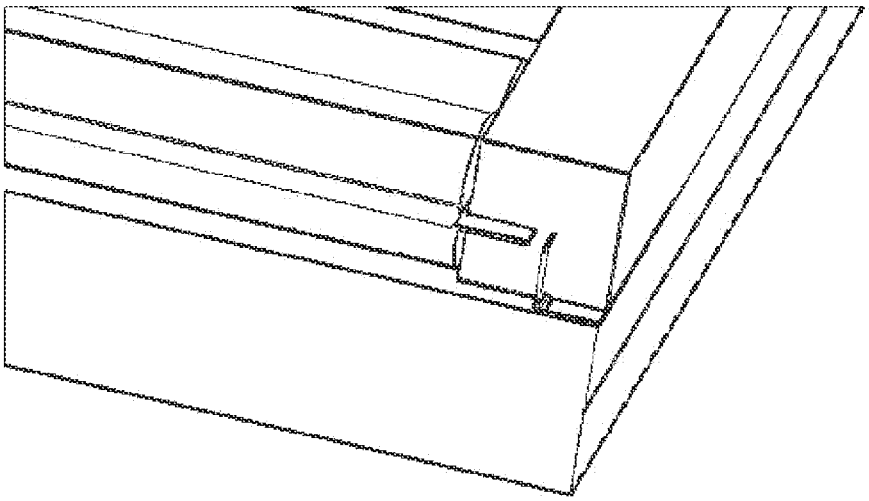

In a specific embodiment, there are two ways to connect and fix the airbag: zipper connection (FIG. 12) and buckle connection (FIG. 13). The zipper connection is shown in FIG. 12. The outer edge of the airbag is provided with a zipper 435, and is fixedly connected with the outer frame by the zipper 435. FIG. 13 shows the structure of buckle connection. The end of the airbag is provided with a buckle, and is connected with the outer frame by a fixed buckle. Then, the edge strip of the outer frame and the outer edge of the airbag are clamped in the middle of the sponge, and glued with the sponge glue spraying, as shown in FIG. 14.

Sponges around the airbag are mainly used to fix the airbag and make the outline of the whole mattress clearer. Usually, some relatively hard sponges are used. The role of the middle sponge is to fix the outer edges of the left and right of the airbag, and also to fill the gaps between the left and right airbags to get a better sleep. Airbag gap sponges are mainly used to fill the gap between the front and back of the airbag to reduce the discomfort caused by the uneven surface of the airbag in the inflated state.

The silent air pump box and the control box are placed at the tail of the bed, that is, the position where the feet of the user are located. The advantages of this arrangement are as follows: it brings the user a sense of safety, and at the same time reduces the spread of noise. The airbag inflation ports of the left and right beds are respectively connected to the silent air pump box, while the central control box is mainly used to control the switches of the air pump and the air valve of the silent sound boxes on both sides, as well as air pressure sensing and data processing. The air pressure sensing is mainly used to measure the air pressure of each airbag.

In particular, the airbag in the embodiment of the present disclosure can be made of PVC, TPU, rubber, silica gel, PE, PU, PI, etc., and the softness and hardness of the airbag can be adjusted by inflation and deflation.

In addition to the silent air pump box and multi-area independently adjustable airbags described above, the intelligent adjustment mattress provided by the present disclosure further comprises an air pressure sensor, a data unit and a control unit. The personal sleep information and algorithm parameters of a user are acquired in a pre-entry manner, and the personalized parameter customization of the mattress is completed.

In particular, the above data unit mainly acquires, analyzes and processes the input air pressure analog small signal, and the data unit structurally comprises an air pressure sensing amplifier circuit, an ADC circuit, a main control part, etc. The sensing amplifier circuit mainly filters and amplifies the original analog small signals of each airbag pressure, the ADC circuit performs analog-digital conversion on the amplified signals, and the main control part mainly carries out data preprocessing and algorithm processing and analysis on the digital signals.

In particular, the above control unit mainly controls the air pump and the air valve according to the output of the data unit. The control signal output by the main control unit drives the MOS pipe to control the on/off of the air pump and the air valve.

The personal sleep information and algorithm parameters of a user are acquired in a pre-entry manner, and the personalized parameter customization of the mattress is completed, so that when first using the mattress, the user enters some information of the user, such as some basic information of height, weight, gender and body shape (such as shoulder width, chest circumference, waist circumference, hip circumference, etc. as well as the sizes of clothes and trousers of the user, or the body shape of the user, such as H-type, O-type, V-type, A-type, etc.) as well as the pressure information of basic sleeping posture. That is, according to predetermined postures, such as lying flat, lying sideways, etc., the system will acquire and store the air pressure data of the user in this sleeping posture. The above information will be integrated together as the sleep information of the user, and some basic parameters of the mattress in the adjustment process will be obtained, so as to achieve the purpose of personalized customization of the mattress.

Figure 15:
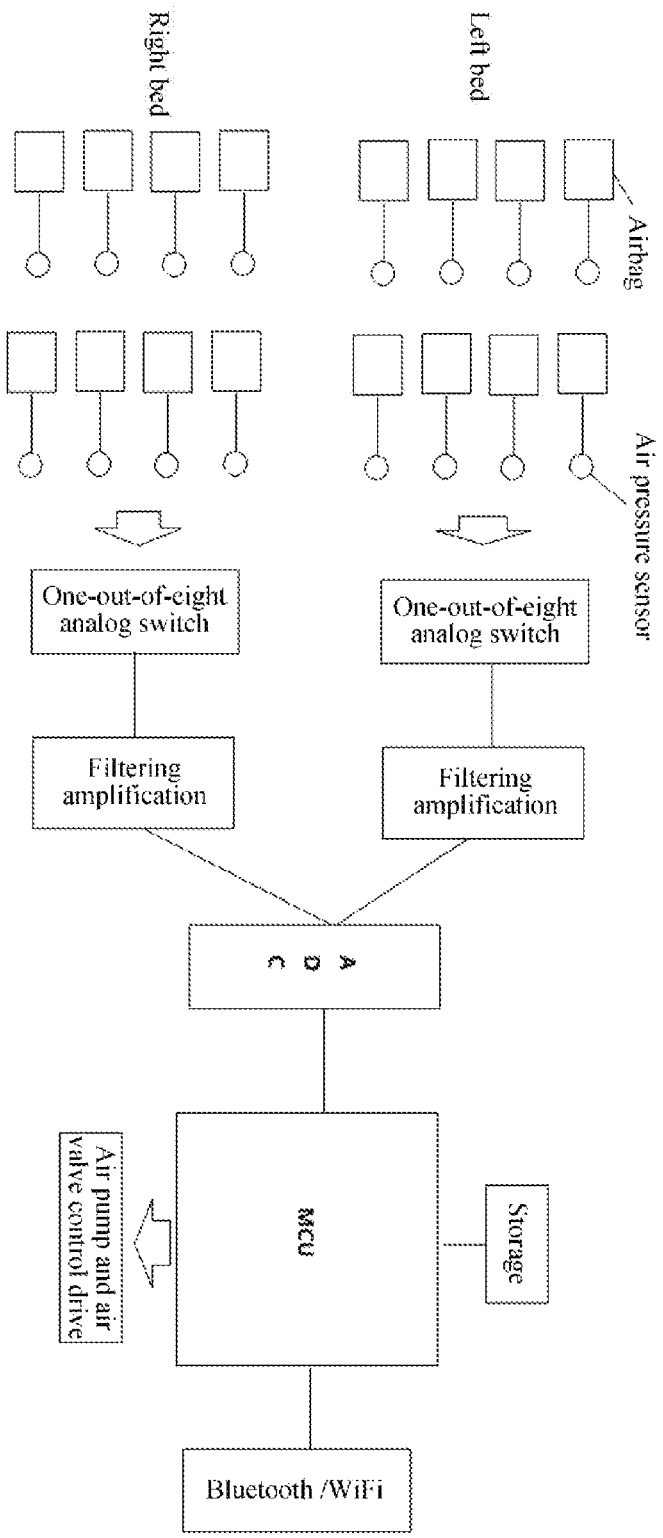
FIG. 15 shows an internal control system structure of an intelligent adjustment mattress according to an embodiment of the present disclosure.

FIG. 15 is the structural diagram of an internal control system of an intelligent adjustment mattress according to one embodiment of the present disclosure. The hardware system of the intelligent adjustment mattress mainly comprises an air pressure sensor, a one-out-of-eight analog switch, a filter amplifier circuit, an ADC analog-to-digital conversion module, a main control chip, a memory, a communication module (such as WIFI or Bluetooth, etc.) and a control drive circuit of an air pump and an air valve. The air pressure sensor is connected with the airbag, which can acquire the air pressure of each airbag in real time, and then transmit the signals of these air pressure sensors to a one-out-of-eight analog switch, so as to save the number of filter amplifier circuits and ADCs. The air pressure is acquired by time-sharing multiplexing, which greatly saves the cost. The filter amplifier circuit mainly amplifies the small signal of air pressure sensing and filters out some high-frequency noise. Then, after ADC analog-to-digital conversion, the signal is input into MCU. MCU mainly plays the functions of a data processing center, a control center and wireless signal transmission control. The memory mainly stores the personal customized data of a user in the process of pre-entry, such as height, weight, body pressure data of various sleeping postures, etc., as well as the sleep data all night of the user, which will be transmitted to a smart phone through Bluetooth. Users can view their sleep reports through APP.

Figure 16:
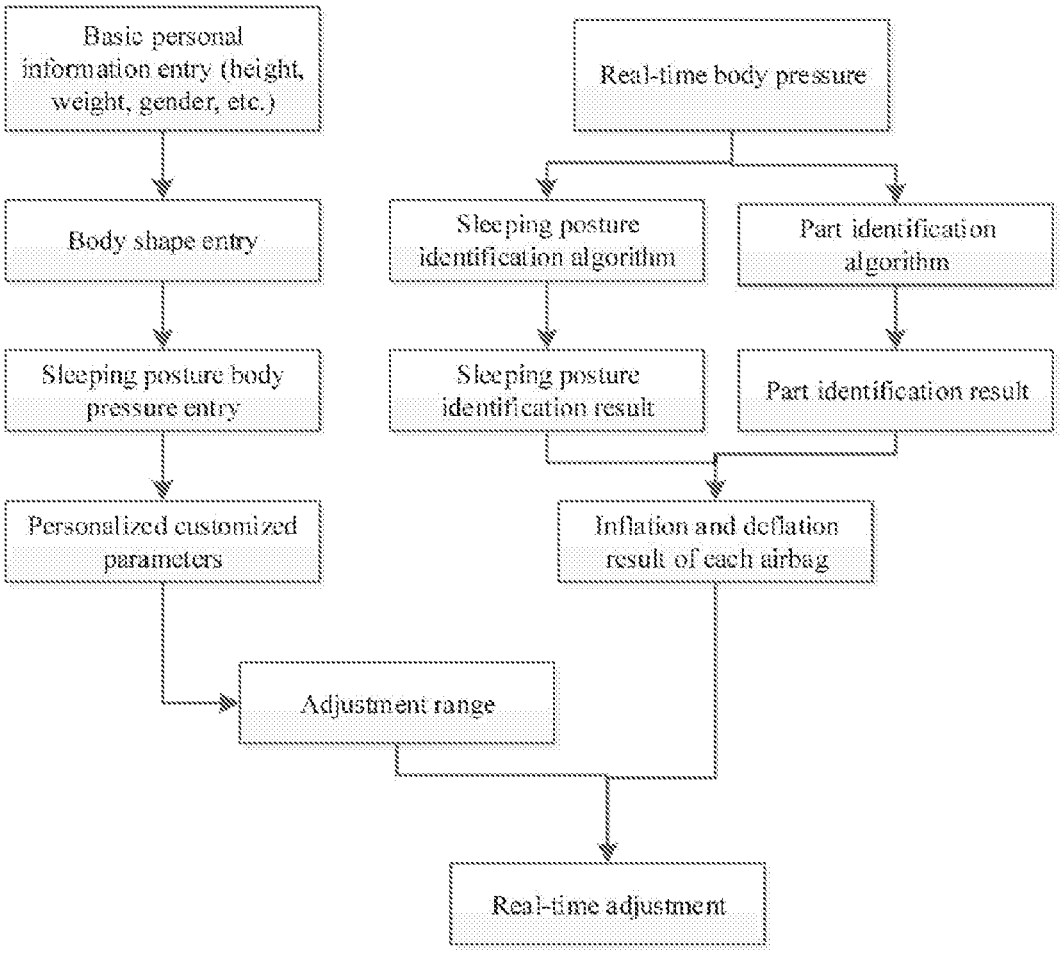
FIG. 16 shows a data pre-entry process of an intelligent adjustment mattress according to an embodiment of the present disclosure.

In particular, the data pre-entry method is shown in FIG. 16. Before users use it for the first time, they must first manually enter personal basic information, including height, weight, gender and so on. Then the body shape of the user is entered. There are two methods. The first method is to enter the shoulder width, chest circumference, waist circumference, hip circumference and other information of the user as well as the sizes of clothes and trousers of the user, or the body shape of the user, such as H-type, O-type, V-type, A-type, etc. After the entry of the first two items, the approximate body model of the user is initially formed. Next, the body pressure in various sleeping postures is entered. According to the prompts, the user lies on the bed in the specified sleeping postures, respectively. The mattress will acquire and store the pressure in this sleeping posture, which will provide parameters for the later sleeping posture identification algorithm. According to the above information, personal customization is completed, and customized parameters are formed, that is, the adjustment range of users in various sleeping postures. For example, according to the height and weight, the airbag area where each part of the person is located can be roughly known and the approximate BMI of the user can be known. According to BMI and the next entry of the body shape, how much air should be inflated and deflated in each part of the user can be known.

For example, if a user has a large hip circumference, the airbag in the hip area should deflate more when he is lying flat. For a person with a wide shoulder width, the shoulder airbag should be adjusted more when he is lying on his side. At this point, the pre-entry process before the use of the user is completed.

Next, in the actual sleep process, the pressure sensor will acquire the real-time pressure data of each airbag, and identify the current sleeping posture of the user through the sleeping posture identification algorithm. For example, the current air pressure matrix of each airbag and the previously pre-entered air pressure matrix of various sleeping postures are subjected to the identification algorithm, and this identification process can be regarded as a pattern identification problem, and further, it can be regarded as a classification problem. The sleeping postures can be identified by the machine learning or deep learning algorithm. After the sleeping posture identification is completed, it is necessary to identify the parts, that is, identify the number of the airbag where the shoulder, back, waist, buttocks, legs, feet and other key parts of the user are located. For example, by looking for the air pressure gradient of each airbag and the current sleeping posture in combination with the prior actual body shape and height data entered by the user, the airbag where the part of the user is located can be judged. For example, for waist identification, the number of the airbag where the waist of the user is located can be roughly judged by the height of the user. Usually, for the waist position, due to the S-shaped curve of the human spine, when lying flat, there is often a larger rising gradient from the waist to the hip. In combination with the actual body shape of the user, the airbag number with the largest increase in body pressure can be found, and the waist position can be located.

After the sleeping posture identification and the part identification of the user are completed, how to inflate and deflate each airbag can be known. As for how much to inflate and deflate, it is required to control the inflation and deflation time in combination with the previously pre-entered adjustment ranges of the user in various sleeping postures, so as to achieve the most comfortable adjustment.

Those skilled in the art can clearly understand that for the convenience and conciseness of the description, only the division of the above functional units and modules will be taken as an example. In practical application, the above functions can be assigned by different functional units and modules as needed, that is, the internal structure of the device is divided into different functional units or modules to complete all or part of the functions described above.

The above embodiments are only used to illustrate the technical schemes of the present disclosure, rather than to limit the technical schemes. Although the present disclosure has been described in detail with reference to the foregoing embodiments, those skilled in the art should understand that it is still possible to modify the technical schemes described in the foregoing embodiments or to equivalently replace some technical features thereof. However, these modifications or substitutions do not make the essence of the corresponding technical schemes deviate from the spirit and scope of the technical schemes of each embodiment of the present disclosure, and should be included in the scope of protection of the present disclosure.

What is claimed is:

1. A silent air pump box, comprising a box body, an upper cover, a supporting platform, an air pump, an air valve, an air pipe, a silencer cotton, a sound insulation cotton and a silencing pipe, wherein the box body is configured to be buckled with the upper cover to form a closed space, the supporting platform, the air pump, the air valve, the air pipe, the silencer cotton and the silencing pipe are all provided in the box body, and the air pump, the air valve, the air pipe and the silencing pipe are all suspended and fixed below the supporting platform, wherein the air pump is suspended under the supporting platform by a suspension belt which is a silicone belt or a rubber belt, and the upper cover and the supporting platform are detachably connected or integrated.

2. The silent air pump box of claim 1, wherein an air valve flexible cushion is provided between the air valve and the supporting platform.

3. The silent air pump box of claim 1, wherein the silencing cotton and the sound insulation cotton are provided inside both the box body and the upper cover from outside to inside.

4. The silent air pump box of claim 1, wherein the supporting platform is provided in the box body through a plurality of supporting columns, and the bottom of the supporting columns is bonded with a silica gel or rubber structure.

5. An intelligent adjustment mattress comprising the silent air pump box of claim 1, and an airbag layer, wherein the silent air pump box is provided at a tail of the intelligent adjustment mattress.

6. The intelligent adjustment mattress of claim 5, wherein the airbag layer comprises multi-area independently adjustable airbags and sponges, wherein the airbags are surrounded by the sponges, and the sponges surrounding the airbags are divided into airbag peripheral sponges, airbag gap sponges and airbag middle sponges.

7. The intelligent adjustment mattress of claim 5, wherein in the airbag layer, the width of an airbag in a trunk area is smaller than that in leg and head areas.

8. The intelligent adjustment mattress of claim 5, wherein air is injected or a spring or sponge is implanted into the airbag layer, and a height of the spring or sponge is not less than half of an inner height of the airbag layer.

9. The intelligent adjustment mattress of claim 5, wherein the intelligent adjustment mattress further comprises an air pressure sensor, a data unit and a control unit, and the intelligent adjustment mattress acquires the personal sleep information and algorithm parameters of a user in a pre-entry manner, so as to realize the personalized parameter customization of the mattress.

10. The intelligent adjustment mattress of claim 5, further comprising an air pressure sensor, a one-out-of-eight analog switch, a filter amplifier circuit, an ADC analog-to-digital conversion module, a main control chip, a memory, a communication module and a control drive circuit of the air pump and the air valve.

* * * * *